US010596433B1

(12) United States Patent
Schutt

(10) Patent No.: US 10,596,433 B1
(45) Date of Patent: Mar. 24, 2020

(54) FIELD HOCKEY TRAINING METHOD

(71) Applicant: James R. Schutt, Vestal, NY (US)

(72) Inventor: James R. Schutt, Vestal, NY (US)

(73) Assignee: James R. Schutt, Vestal, NY (US)

( * ) Notice: Subject to any disclaimer, the term of this patent is extended or adjusted under 35 U.S.C. 154(b) by 0 days.

(21) Appl. No.: 16/196,126

(22) Filed: Nov. 20, 2018

Related U.S. Application Data

(63) Continuation of application No. 15/650,159, filed on Jul. 14, 2017, now abandoned.

(51) Int. Cl.

| | |
|---|---|
| ***A63B 69/00*** | (2006.01) |
| ***A63B 59/70*** | (2015.01) |
| *A63B 102/22* | (2015.01) |

(52) U.S. Cl.
CPC ..... *A63B 69/0024* (2013.01); *A63B 59/70* (2015.10); *A63B 2102/22* (2015.10)

(58) Field of Classification Search
CPC . A63B 69/0024; A63B 69/0026; A63B 69/00; A63B 59/70; A63B 2102/22; A63B 2102/24
USPC ..... 473/466, 422, 444, 458; 482/66
See application file for complete search history.

(56) References Cited

U.S. PATENT DOCUMENTS

| | | | |
|---|---|---|---|
| 6,165,084 | A | 12/2000 | Cranston |
| 7,736,247 | B2 | 6/2010 | Caruso |
| 8,357,061 | B2 | 1/2013 | Quinn |
| 2017/0095717 | A1 | 4/2017 | Simonov |

*Primary Examiner* — Mitra Aryanpour
(74) *Attorney, Agent, or Firm* — George S. Blasiak, Esq.; Heslin Rothenberg Farley & Mesiti P.C.

(57) ABSTRACT

There is set forth herein methods for training field hockey trainees. Methods herein can use a generally cylindrical structure that has holders for holding a field hockey stick in varying positions. According to one method actions for training can be taken with respect to first and second generally cylindrical structures each having holders for holding a field hockey stick in varying positions.

5 Claims, 4 Drawing Sheets

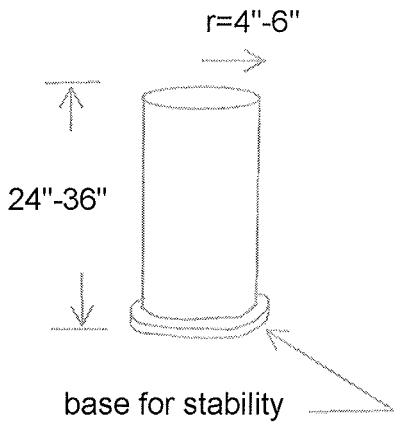
Fig. 1
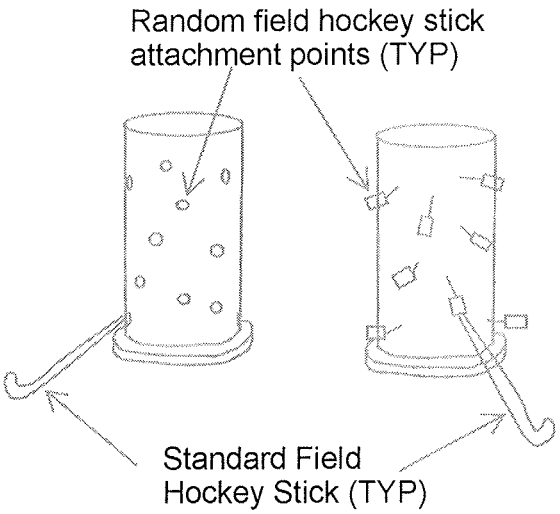
Fig. 2
Fig. 3
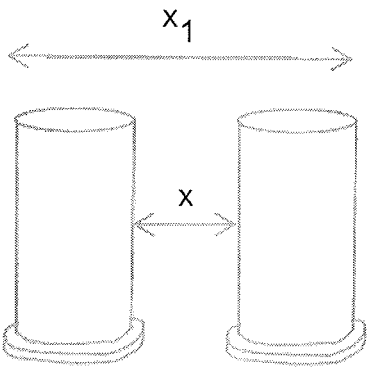
Fig. 4A
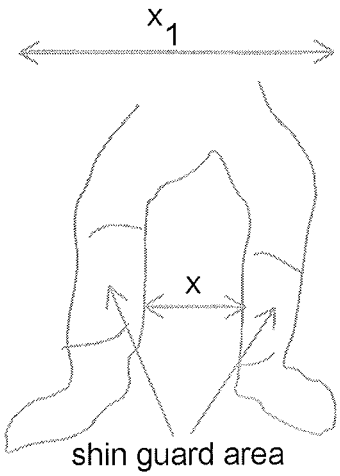
Typical Field Hockey Player Stance
Fig. 4B

1 FHTD1000

2 FHTD1000

Multiple FHTD1000

Field hockey ball lifted into shin area

Shin Guard Area

Field hockey ball placed between shin guard area or legs

FIELD HOCKEY TRAINING METHOD

CROSS-REFERENCE TO RELATED APPLICATION

This application is a continuation of U.S. application Ser. No. 15/650,159, filed Jul. 14, 2017, titled "FHTD1000 Field Hockey Training Device", the entirety of which is hereby incorporated herein by reference.

BACKGROUND

Field hockey is primarily played with three basic components—a stick, a ball, and shin guards (for protection).

SUMMARY

There is set forth herein methods for training field hockey trainees. Methods herein can use a generally cylindrical structure that has holders for holding a field hockey stick in varying positions. According to one method actions for training can be taken with respect to first and second generally cylindrical structures each having holders for holding a field hockey stick in varying positions.

BRIEF DESCRIPTION OF DRAWINGS

FIG. 1 depicts a field hockey training device;

FIG. 2 depicts a field hockey training device having a first type of field hockey stick attachment points;

FIG. 3 depicts a field hockey training device having a second type of field hockey stick attachment points;

FIG. 4A depicts first and second field hockey training devices;

FIG. 4B depicts a typical field hockey player stance;

DETAILED DESCRIPTION

The invention (FHTD1000) is a field hockey training device which replicates the various stick positions a defender may employ while attempting to eliminate an attacking offensive player who has possession of the ball. It promotes, enhances, develops and improves one's offensive ability to maneuver, control, and manipulate the ball while developing fundamental stick skills, fakes, and dodges designed to eliminate an opponent.

A field hockey training device comprised of a molded shape which replicates the size and dimensions of an average foot, ankle, shin, knee, and leg of a human being. Device could be an exact replication of described human body parts but a general outline would also be acceptable. For example, a cylindrical shape approximately 24-36 inches in height and with a radius of 4-6 inches would produce the intended general size and shape required. (FIG. 1) Described device could be a hollow or solid shape with a base incorporated to aid in stability.

Training device would also incorporate provisions for temporally attaching multiple standard field hockey sticks. This could be accomplished by simply drilling holes in the training device with which the handle end of a field hockey stick could be inserted (FIG. 2) or by attaching a clipping device which would hold the handle of the field hockey stick in the desired position. (FIG. 3) Said clipping devices would need to rotate to allow random stick angles.

Two devices utilized in tandem and spaced appropriately would replicate the general stance and defending position of a field hockey player. This is an important claim of my invention as it replicates the actual foot and leg positions of a defender which adds an element of realism while training with my invention. (FIG. 4)

Figure 5A:
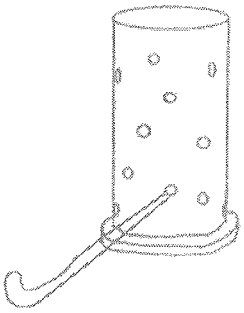
FIG. 5A depicts a field hockey training device holding a field hockey stick.
Figure 5B:
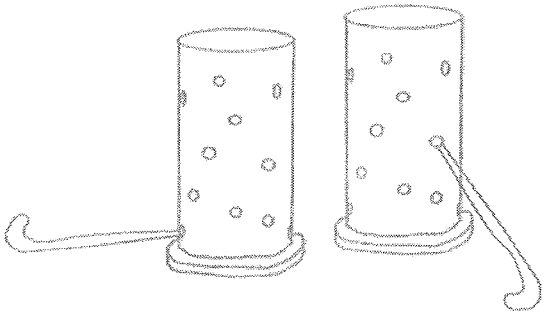
FIG. 5B depicts first and second field hockey training devices each holding a field hockey stick.
Figure 5C:
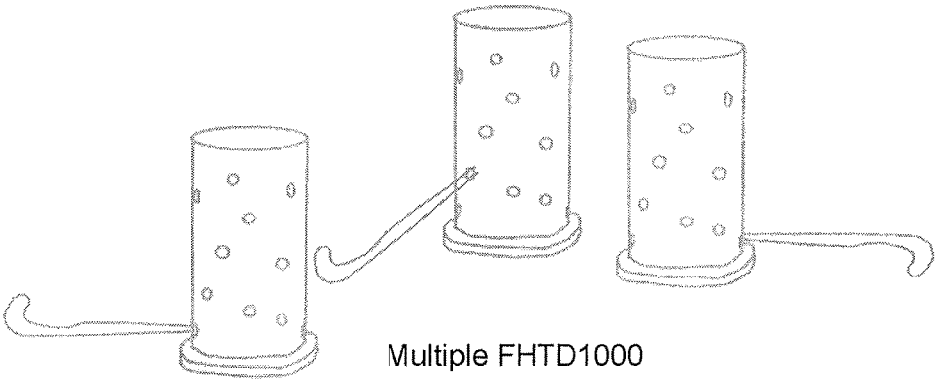
FIG. 5C depicts first, second and third field hockey training devices each holding a field hockey stick.

One, two, or multiple devices can be utilized in tandem to replicate a defenders position and stick placement. (FIG. 5)

This invention relates to the accelerated development of skill techniques inherently found and necessary in the sport of field hockey by incorporating the use of a faux defender to develop offensive ball possession proficiency, mental awareness, and stick skill development.

The sport of field hockey is universally recognized as a passing and possessing game. The art of dodging or out maneuvering your opponent while maintaining possession of the ball is considered a basic skill of the sport. This invention accelerates the development of one's ball possession ability by developing and enhancing various fakes, moves, and dodges in order to become proficient in eliminating ones opponent or drawing a foul on an attacking defender.

Field hockey is primarily played with three basic components—a stick, a ball, and shin guards (for protection). Rules dictate only one side of the stick can be utilized to manipulate the ball. This creates several distinct body and wrists movements inherent to the sport and inherent to training development. A player that can transition the ball quickly from left to right, or across their body can become very effective in eliminating a defender for example. Likewise, a defender who can manipulate an offensive ball carrier by utilizing their body movement and stick position can become proficient in stopping an offensive ball carrier.

Figure 6:
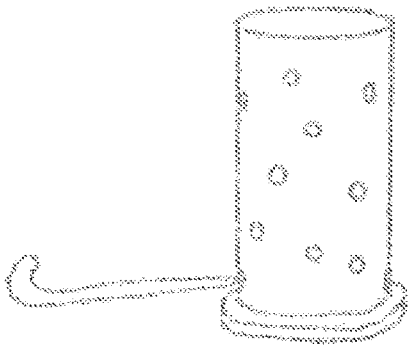
FIG. 6 depicts a field hockey training device holding a field hockey stick.
Figure 7:
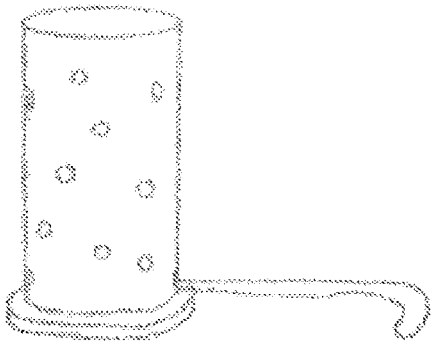
FIG. 7 depicts a field hockey training device holding a field hockey stick.

A defender may employ several key stick movements or stick placements in an attempt to stop the ball carrier, intercept the ball, or otherwise force a turn over. This is completed by strategically positioning their stick in relation to the ball carrier to gain possession of the ball. The stick can be laid or placed horizontally flat on the ground to either side of the body in a blocking position (FIGS. 6 and 7).

Figure 8:
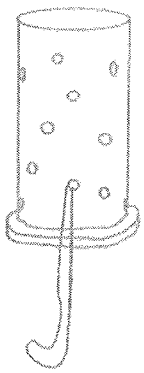
FIG. 8 depicts a field hockey training device holding a field hockey stick.
Figure 9:
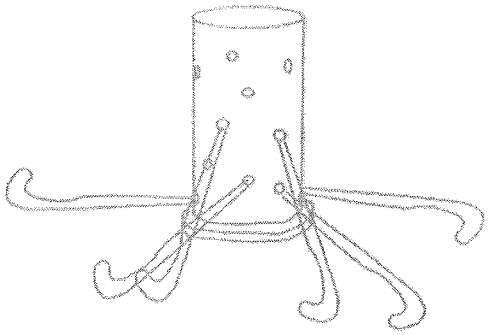
FIG. 9 depicts a field hockey training device holding a plurality of field hockey sticks in a plurality of different positions.

It can be thrust forward in an attempt to disrupt or influence the offensive player's movement and/or strike and move the ball from the offenders stick in a dynamic fashion (FIG. 8). It can also be placed in a random pattern to replicate a defenders stick movement thus making it a very effective simulation tool and training device (FIG. 9). Defensive movements are designed to disrupt and influence the ball carrier by taking away her field vision. Eliminating an offensive player's vision is a fundamental concept in the sport of field hockey. This invention allows offensive players to repeatedly replicate on field movements and reactions necessary due to a defenders possible stick position(s) thus learning and practicing ball movement skills to improve one's ability.

This invention simulates a defenders stick placement at the critical moment and in a specific area in relation to the offensive player's ball placement and ball movement allowing the development of fundamental stick skills.

Another important and fundamental field hockey concept when in possession of the ball is the attempt to lift the ball off the ground slightly with your stick and into the defenders shin guards or feet. This results in a defensive foul and is another tactical movement an offensive player can employ to eliminate a defender. The scope of my invention not only simulates the stick movement and stick placement a defender can employ, but it also replicates the average height and location of a defenders shin guard area. It is important to note that generally a ball lifted or played above the waist is considered dangerous, therefore it is important to control the height of the ball when attempting a lift.

Figure 10:
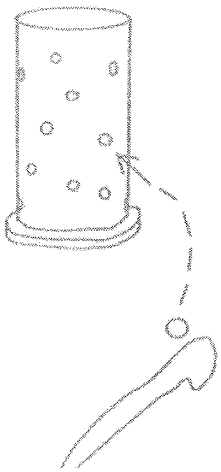
FIG. 10 depicts a field hockey training device and a field hockey ball lifted into a shin area defined by the field hockey training device.

My invention provides a platform with which to practice this skill. (FIG. 10)

Figure 11:
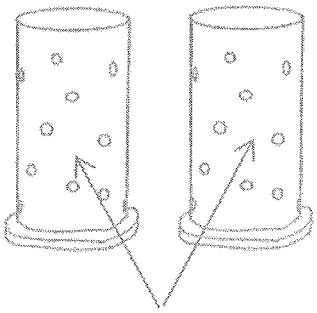
FIG. 11 depicts first and second field hockey training devices.

Additionally, two devices may be utilized in tandem to replicate the "two" legs, shin guards, and feet of a defender which adds an additional element of realism. (FIG. 11)

Figure 12:
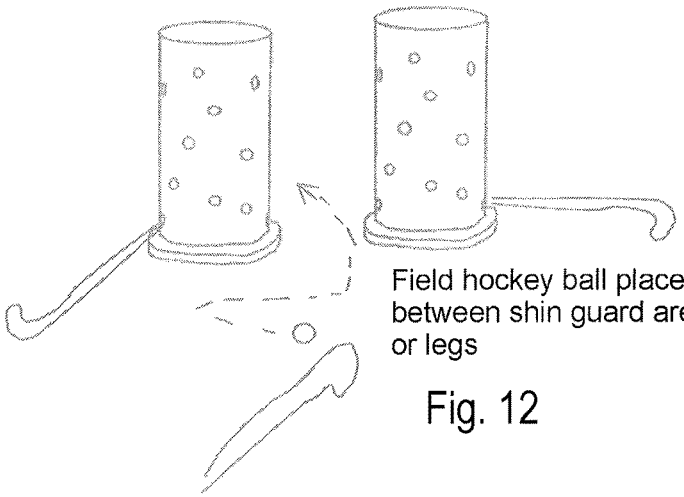
FIG. 12 depicts first and second field hockey training devices and further depicts a field hockey ball placed between the first and second field hockey training devices.

Trainees can now practice placing and/or lifting the ball between a defenders "legs" which is also another field hockey elimination tactic. (FIG. 12)

Figure 13A:
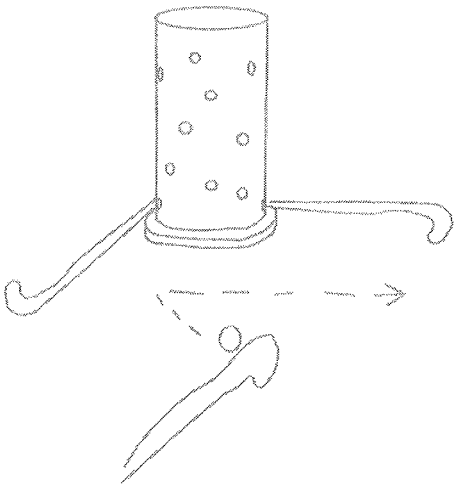
FIG. 13A depicts a field hockey training device holding a first field hockey stick and a second field hockey stick.
Figure 13B:
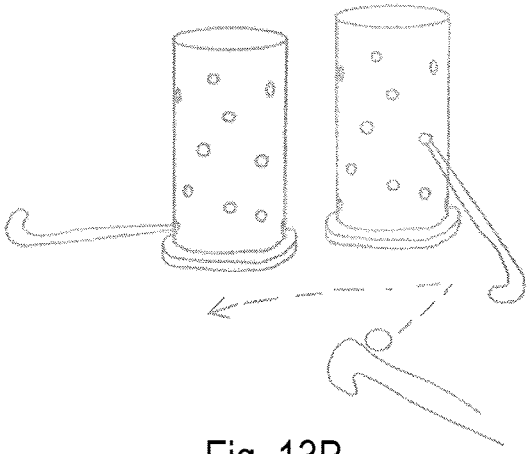
FIG. 13B depicts first and second field hockey training devices each holding a field hockey stick.

Finally, multiple sticks can be employed on my invention which places additional demands on the trainee resulting in the increased development of stick speed and ball movement. (FIG. 13).

What is claimed is:

1. A method for training a field hockey trainee comprising:

(a) passing a field hockey ball, by the field hockey trainee, between a first generally cylindrical structure and a second generally cylindrical structure so that the field hockey trainee is trained with respect to an offensive maneuver of passing a ball between shins of a defender, wherein the first generally cylindrical structure is supported so that the first generally cylindrical structure extends generally vertically, the first generally cylindrical structure having a height and diameter corresponding to a field hockey defender shin, the first generally cylindrical structure having formed therein a plurality of spaced apart holders adapted to receive a handle end of a field hockey stick, wherein the second generally cylindrical structure is supported so that the second generally cylindrical structure extends generally vertically, the second generally cylindrical structure having a height and diameter corresponding to a field hockey defender shin, the second generally cylindrical structure having formed therein a plurality of spaced apart holders adapted to receive a handle end of a field hockey stick, wherein the first generally cylindrical structure and the second generally cylindrical structure are positioned so that a spacing distance between the first generally cylindrical structure and the second generally cylindrical structure generally corresponds to a distance between first and second shins of a defender;

(b) lifting a hockey ball, by the field hockey trainee, onto one of the first generally cylindrical structure or the second generally cylindrical structure so that the field hockey trainee is trained with respect to an offensive maneuver of eliminating a defender by incurring a foul on a part of a defender;

(c) with a handle of a first stick received in a first holder of the first generally cylindrical structure, and with a handle of a second stick supported in a first holder of the second generally cylindrical structure, maneuvering a ball, by the field hockey trainee, in an area of the first stick and the second stick to avoid the first stick and the second stick so that the field hockey trainee is trained with respect to defeating a first defensive position of a defender; and (d) with one or more of the first stick or the second stick changed from the position indicated in (c) maneuvering a ball for training, by the field hockey trainee, in an area of the first stick and the second stick to avoid the first stick and the second stick so that field hockey trainee is trained with respect to defeating a second defensive position of a defender.

2. The method of claim 1, wherein with respect to the stick positions indicated in (c) the first stick is positioned to have a higher handle elevation than the second stick.

3. The method of claim 1, wherein with respect to the stick positions indicated in (c) the first stick extends generally forwardly from the first generally cylindrical structure, and the second stick extends generally sideward from the second generally cylindrical structure.

4. The method of claim 1, wherein the holders of the first generally cylindrical structure include apertures.

5. The method of claim 1, wherein the holders of the first generally cylindrical structure include clips.

* * * * *